United States Patent [19]

Iknadossian

[11] Patent Number: 4,746,454

[45] Date of Patent: May 24, 1988

[54] ORGANIC DISH AND HAND WASHING COMPOUND CONTAINING RAW POTATO PULP

[76] Inventor: Leon Iknadossian, P.O. Box 2022, City of Industry, Calif. 91746

[21] Appl. No.: 98,920

[22] Filed: Sep. 21, 1987

[51] Int. Cl.[4] ..... C11D 1/04; C11D 3/34; C11D 3/382; C11D 17/08

[52] U.S. Cl. ..... 252/170; 252/89.1; 252/132; 252/174.17; 252/174.21; 252/DIG. 1; 252/DIG. 14

[58] Field of Search ..... 252/87, 174.17, 132, 252/89.1, 174.21, 367, 368, 369, DIG. 14, 162, 170, DIG. 1

[56] References Cited

U.S. PATENT DOCUMENTS 59,724 11/1866 Milne ..... 252/130
369,325 9/1887 Dooley ..... 252/87
4,568,555 2/1986 Spanier ..... 426/582
4,702,856 10/1987 Iknadossian ..... 252/170

FOREIGN PATENT DOCUMENTS 0003395 of 1883 United Kingdom ..... 252/180
0008673 of 1904 United Kingdom ..... 252/180

*Primary Examiner*—Paul Lieberman
*Assistant Examiner*—Kathleen Markowski

[57] ABSTRACT

A cleaning composition efficient for washing dishes and hands is disclosed. A preferred embodiment of the composition contains about 88.5% raw potato pulp, about 1.0% sodium bisulphite, about 0.5% sodium stearyl fumerate, about 5.0% 190 proof denatured alcohol, about 5.0% nonionic surfactant, and a trace of artificial food coloring and fragrance.

1 Claim, No Drawings

ORGANIC DISH AND HAND WASHING COMPOUND CONTAINING RAW POTATO PULP

DISCLOSURE OF THE INVENTION

The present invention provides a dish and hand washing compound which when applied to dishes or hands will effectively remove dirt, grime, or grease as the dishes or hands are thoroughly rinsed with water immediately after vigorously applying the compound.

The compound is dispensed from a wide-mouthed jar or can.

While the foregoing illustrates a preferred mode and purpose for the use of the present invention, other uses of the basic concept of the present invention can also be practiced.

DESCRIPTION OF THE PREFERRED EMBODIMENT AND FORMULATION

In its preferred execution, the present invention provides an organically-based product which is composed of the following:

| Ingredients: | | Ratio: |
|---|---|---|
| Raw potato pulp | About | 88.5% |
| Sodium bisulphite | " | 1.0% |
| Sodium stearyl fumerate | " | .5% |
| Denatured alcohol 190 proof | " | 5.0% |
| Nonionic surfactant | " | 5.0% |
| Artificial food coloring | | Trace |
| Artificial fragrance | | Trace |
| | | 100.0% |

It can also be appreciated that the present invention offers a relatively more effective agent for washing dishes and hands because of its largely organic composition.

Importantly, it will be readily recognized that the product of this invention can be used for a variety of dirt and grease removal activities. In its broadest aspect, this versatility clearly distinguishes the present invention from the rest of cleansing agents.

I claim:

1. A composition for washing dishes and hands comprising about 88.5% raw potato pulp, about 1.0% sodium bisulphite, about 0.5% sodium stearyl fumerate, about 5.0% denatured 190 proof alcohol, about 5.0% nonionic surfactant, and a trace of artificial food coloring and fragrance.

* * * * *